US006663055B2

(12) United States Patent
Boucher et al.

(10) Patent No.: US 6,663,055 B2
(45) Date of Patent: Dec. 16, 2003

(54) ARMBOARD ASSEMBLY

(75) Inventors: Michael Boucher, Ashburnham, MA (US); Matthew Cavanaugh, Groton, MA (US); Kip P. VanSteenburg, Sudbury, MA (US); George T. Wong, Chelmsford, MA (US)

(73) Assignee: The OR Group, Inc., Acton, MA (US)

( * ) Notice: Subject to any disclaimer, the term of this patent is extended or adjusted under 35 U.S.C. 154(b) by 138 days.

(21) Appl. No.: 09/802,441

(22) Filed: Mar. 9, 2001

(65) Prior Publication Data

US 2001/0039680 A1 Nov. 15, 2001

Related U.S. Application Data

(60) Provisional application No. 60/189,679, filed on Mar. 15, 2000.

(51) Int. Cl.[7] ..... B68G 5/00

(52) U.S. Cl. ..... 248/118; 248/279.1; 248/276.1; 5/646

(58) Field of Search ..... 248/181.1, 279.1, 248/287.1, 227.4, 231.85, 231.81, 118, 278.1, 103, 105, 106; 403/56, 71, 83, 144, 90; 269/75, 76; 5/624, 646, 658

(56) References Cited

U.S. PATENT DOCUMENTS

| | | | | | |
|---|---|---|---|---|---|
| 541,863 | A | * | 7/1895 | Loomis | |
| 898,898 | A | * | 9/1908 | Kahn | |
| 1,446,811 | A | * | 2/1923 | Rowland | |
| 1,516,795 | A | * | 11/1924 | Schwarting | |
| 2,073,089 | A | * | 3/1937 | Autenrieth | 248/276.1 |
| 2,119,325 | A | * | 5/1938 | Goodhart | |
| 2,669,958 | A | * | 2/1954 | Sweeney | |
| 2,972,505 | A | | 2/1961 | Weickgenannt | |
| 3,627,339 | A | * | 12/1971 | Burweger | 279/8 |
| 4,211,392 | A | * | 7/1980 | De Santis | 269/75 |
| 4,526,355 | A | * | 7/1985 | Moore | 269/328 |
| 5,104,103 | A | | 4/1992 | Auchinleck et al. | |
| 5,135,210 | A | | 8/1992 | Michelson | |
| 5,560,577 | A | | 10/1996 | Keselman | |
| 5,582,379 | A | * | 12/1996 | Keselman | 248/279.1 |
| 5,802,641 | A | | 9/1998 | Van Steenburg | |
| 5,918,330 | A | | 7/1999 | Navarro et al. | |
| 5,961,085 | A | | 10/1999 | Navarro et al. | |
| 6,210,325 | B1 | * | 4/2001 | Bartie | 600/229 |

* cited by examiner

*Primary Examiner*—Leslie A. Braun
*Assistant Examiner*—Gwendolyn Baxter
(74) *Attorney, Agent, or Firm*—Barnes & Thornburg

(57) ABSTRACT

The illustrative armboard assembly includes a lockable first joint coupling an armboard to a support arm, a lockable second joint coupling the support arm to a mounting post and a lockable third joint coupling the mounting post to a mounting rail. The first joint is configured to permit movement of the armboard along the support arm and configured to permit movement of the armboard relative to the support arm about a first plurality of axes. The second joint is configured to permit movement of the support arm relative to the mounting post about a second plurality of axes. The third joint is configured to position the mounting post in a selected vertical position relative to the mounting rail and in a selected longitudinal position along the mounting rail.

38 Claims, 11 Drawing Sheets

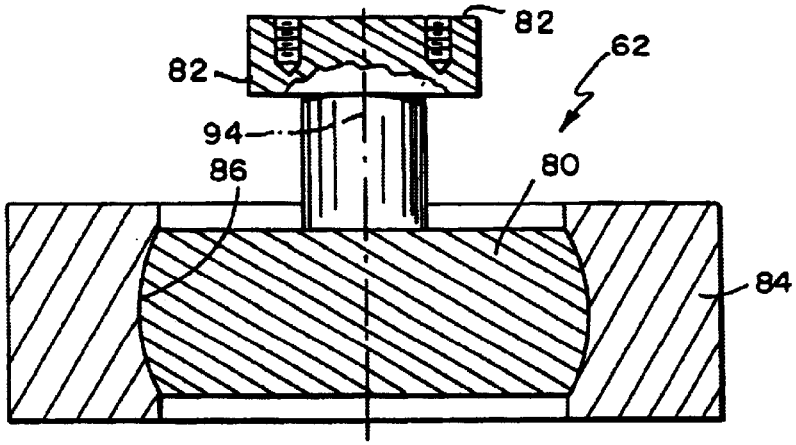
FIG. 5
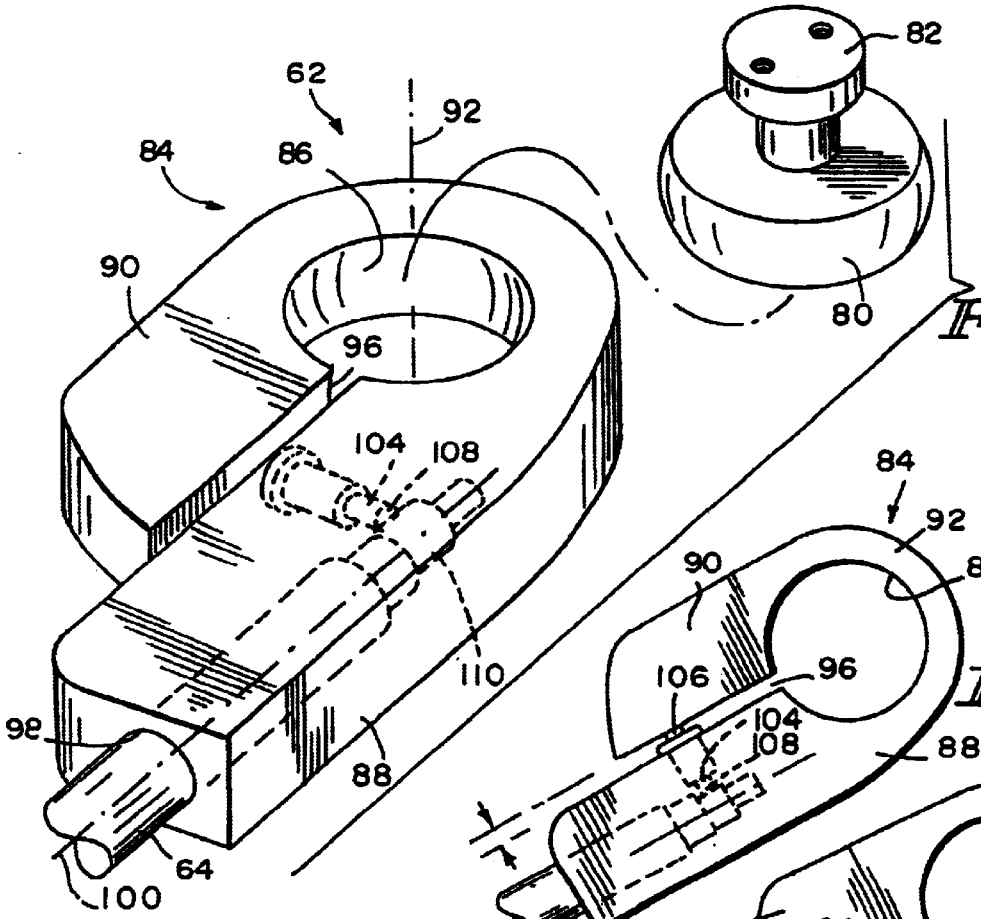
FIG. 6
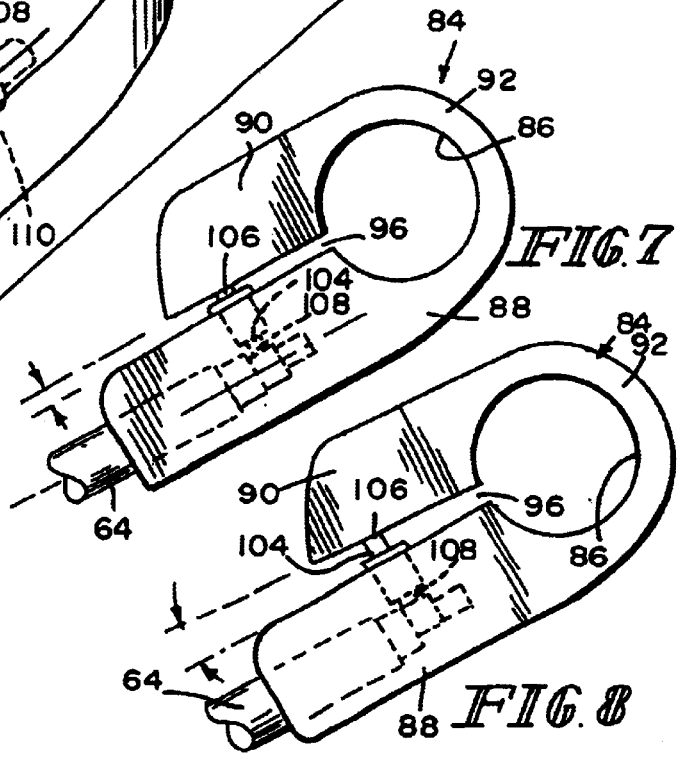
FIG. 7
FIG. 8

ARMBOARD ASSEMBLY

This application claims the benefit of U.S. Provisional Patent Application, Ser. No. 60/189,679, filed on Mar. 15, 2000, and entitled "ARMBOARD ASSEMBLY".

BACKGROUND AND SUMMARY OF THE INVENTION

The present invention generally relates to an armboard assembly. More particularly, the present invention relates to an armboard assembly for attaching an accessory, such as an armboard, to a patient support, such as a surgical table.

For hand, arm and shoulder surgeries, an armboard or a hand table is attached to a mounting rail of a surgical table. It is known to attach an armboard to a surgical table so that the armboard is adjustable in a horizontal plane about a vertical axis. It is also known to position the armboard in a selected vertical position relative to the mounting rail and in a selected horizontal position along the mounting rail. Two examples of armboard assemblies are disclosed in U.S. Pat. Nos. 2,972,505 and 5,135,210. Both these references are incorporated herein by reference in their entirety to establish the nature of such patient supports and such adjustable support assemblies.

It is desirable to provide an armboard assembly that gives the armboard multiple degrees of freedom so that a patient's arm can be supported during a shoulder surgery in a natural position. The illustrative armboard assembly of the present invention includes a lockable first joint coupling an armboard to a support arm, a lockable second joint coupling the support arm to a mounting post and a lockable third joint coupling the mounting post to a mounting rail. The first joint is configured to permit movement of the armboard along the support arm and configured to permit movement of the armboard relative to the support arm about a first plurality of axes. The second joint is configured to permit movement of the support arm relative to the mounting post about a second plurality of axes. The third joint is configured to position the mounting post in a selected vertical position relative to the mounting rail and in a selected longitudinal position along the mounting rail.

Although this invention is described in the context of attaching an armboard to a surgical table, it is equally applicable for attaching an armboard to a surgical chair or stretcher. So the term "surgical table" as used in this description shall be understood to mean any type of patient support, such as a surgical table, chair, stretcher or a bed.

Additional features of the present invention will become apparent to those skilled in the art upon a consideration of the following detailed description of the preferred embodiments exemplifying the best mode of carrying out the invention as presently perceived.

BRIEF DESCRIPTION OF THE DRAWINGS

The detailed description particularly refers to the accompanying figures in which:

FIG. 5 is a diagrammatic partial sectional view of the swivel joint along its center line, the swivel joint including a split housing configured to form a spherical seat for receiving a spherical disc, the split housing being configured to be coupled to the support arm and the spherical disc being configured to be coupled to the post, FIG. 6 is a diagrammatic exploded perspective view showing the split housing and the spherical disc, FIG. 7 is a diagrammatic plan view of the split housing in a normal locked position in which the two halves of the split housing constrict around the spherical disc to prevent any relative motion between the two, FIG. 8 is a diagrammatic plan view of the split housing similar to FIG. 7, but in an unlocked position in which the two halves are spread apart to loosen their grip on the spherical disc to allow the split housing to turn relative to the spherical disc about a first plurality of axes.

DETAILED DESCRIPTION

Figure 1:
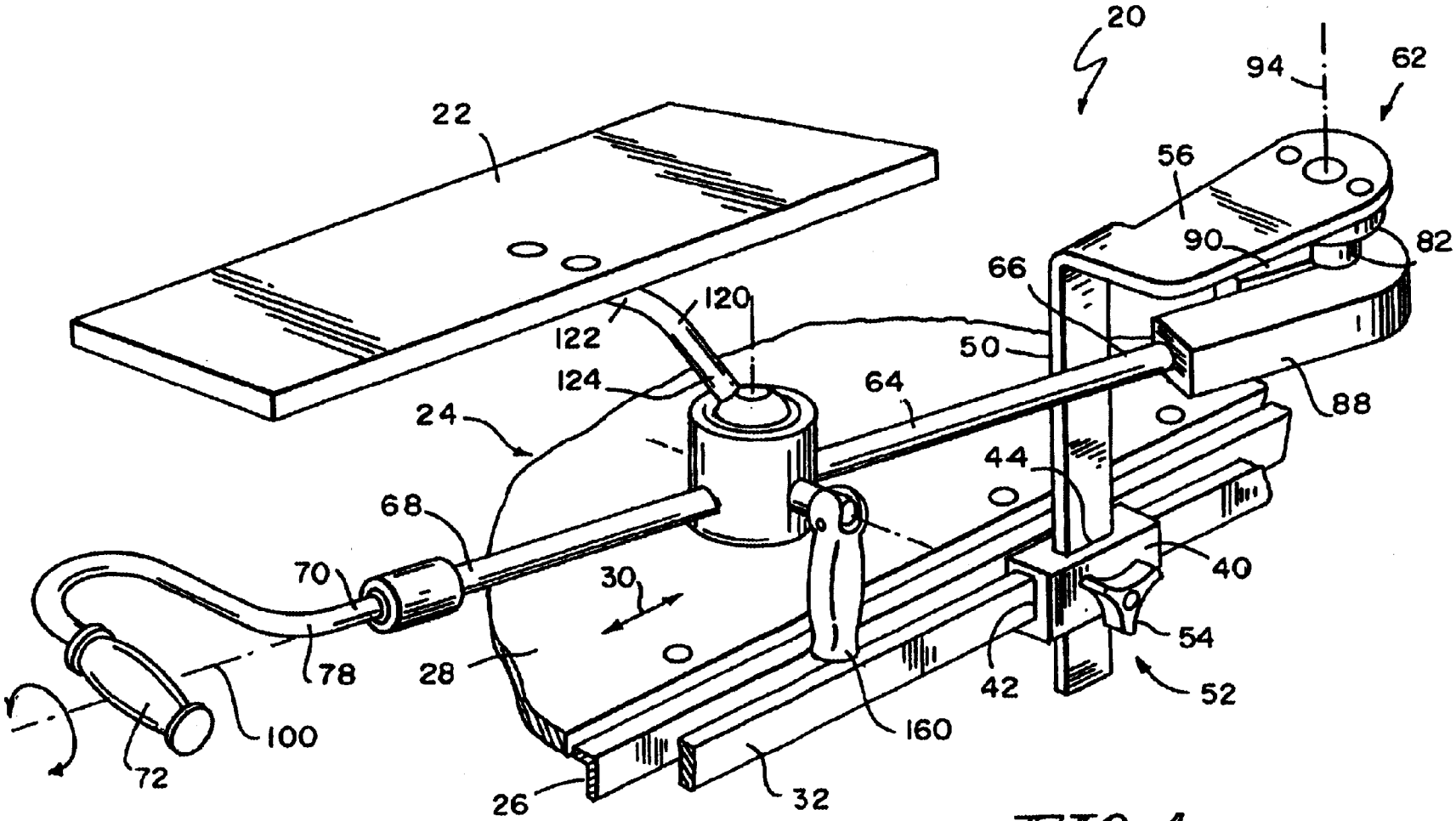
FIG. 1 is a perspective view showing an illustrative armboard assembly including a mount coupled to a mounting rail, a mounting post coupled to the mount, a clamp configured to lock the mounting post in a selected vertical position relative to the mount and lock the mount in a selected longitudinal position along the rail, a lockable swivel joint coupled to the mounting post for rotation about a first plurality of axes, a support arm coupled to the swivel joint, a handle coupled to the support arm to unlock the swivel joint, a support assembly axially movable along the support arm, a lockable ball joint coupled to the support assembly for rotation about a second plurality of axes, a lever coupled to the support assembly to lock the support assembly in a selected axial position along the support arm and lock the ball joint against movement, and an armboard support coupling the armboard to the ball joint.
Figure 9:
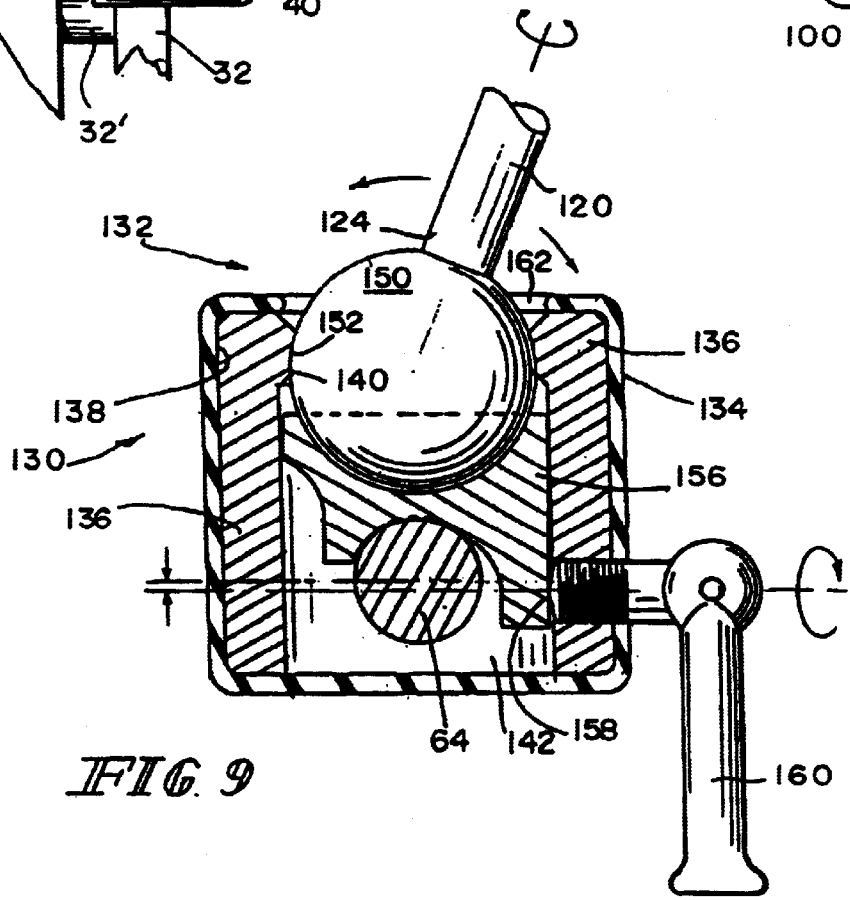
FIG. 9 is a sectional view of the ball joint along its center line, the ball joint coupling the support arm to the armboard.
Figure 10:
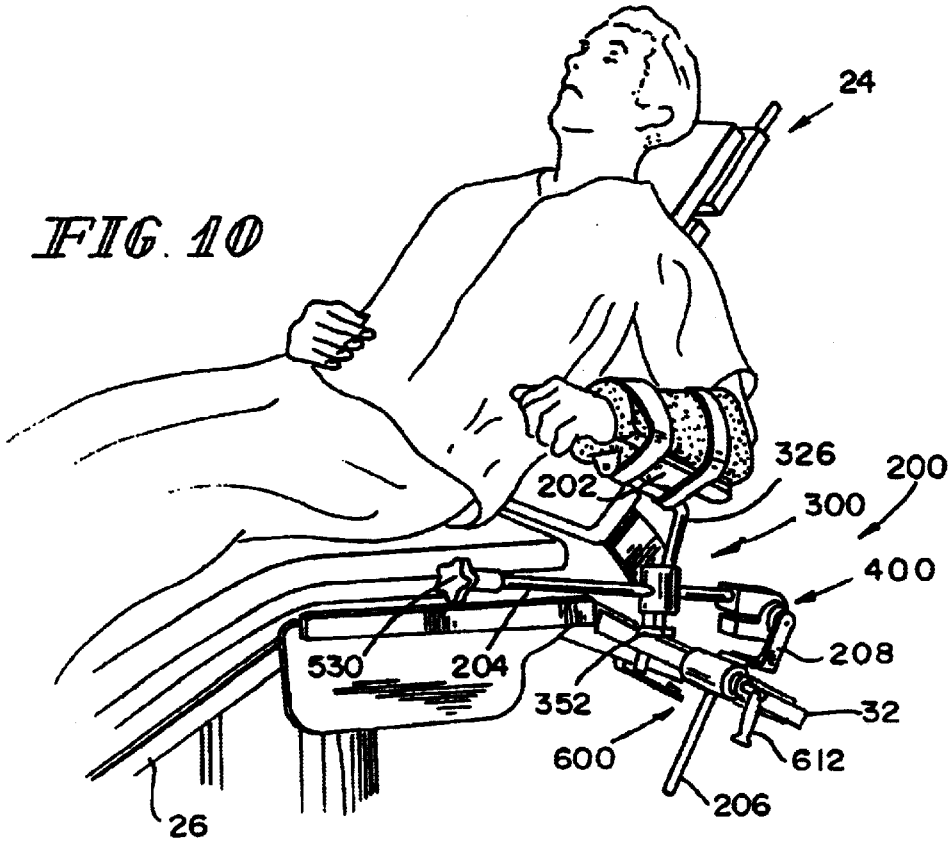
FIG. 10 is a perspective view of a second embodiment of the armboard assembly attached to a mounting rail of a surgical table, and showing a patient supported on the surgical table in a reclining position with the patient's arm strapped to an armboard at his side, the FIG. 10 armboard assembly including a lockable first swivel joint coupling the armboard to a support arm, a lockable second swivel joint coupling the support arm to a mounting post and a lockable third joint coupled to the mounting post and configured to be coupled to the mounting rail.
Figure 11:
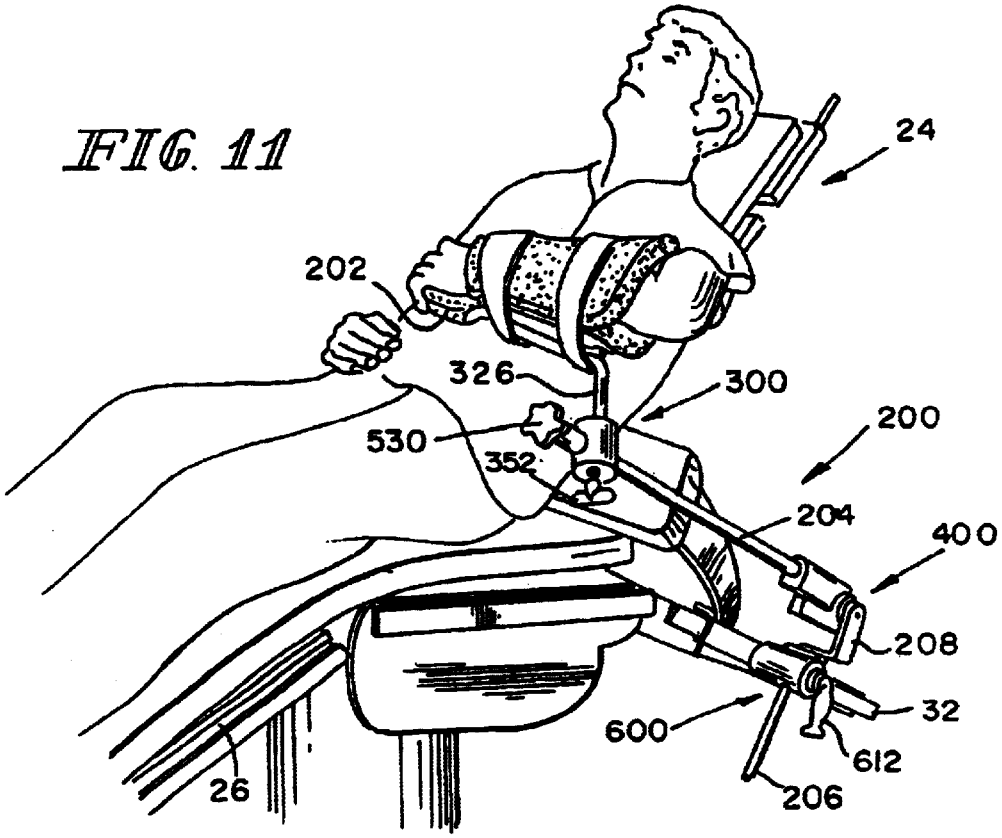
FIG. 11 is a perspective view similar to FIG. 10 showing the patient's arm strapped to the armboard in front of the patient.

Referring to FIGS. 1–9 in general and FIG. 1 in particular, an illustrative armboard assembly 20 (also referred to as support assembly) attaches an armboard 22 to a surgical table 24 having a deck 26. The deck 26 includes a generally horizontal patient support surface 28 having a longitudinal dimension 30. Mounting rails 32 extend along the longitudinal dimension 30 on opposite sides of the table 24. The mounting rails 32 are secured to the deck 26 by studs 32'. The armboard assembly 20 includes three lockable joints: 1) a lockable first swivel joint coupled to the armboard 22 and coupled to a support arm 64, 2) a lockable second swivel joint coupled to the support arm 64 and coupled to a mounting post 50, and 3) a lockable third joint coupled to the mounting post 50 and configured to be coupled to the mounting rail 32. The illustrated armboard 22 is generally flat and has a rectangular configuration. However, the armboard 22 may be curved to follow the contour of the patient's arm, for example, as shown in FIGS. 10 and 11. The armboard 22 is made from radiolucent material to facilitate fluoroscopic imaging. The armboard 22 may be enclosed in a disposable pad (not shown).

The terms "swivel joint" and "ball joint" are used in this description and claims interchangeably. The terms "swivel joint" and "ball joint" as used in this description and claims mean any joint that allows simultaneous movement or rotation of one part relative to the other about a plurality of axes. Also, it will be understood that the support assembly 20 may be used in conjunction with any type of patient support—such as a surgical table, chair, stretcher, or a hospital bed.

Figure 2:
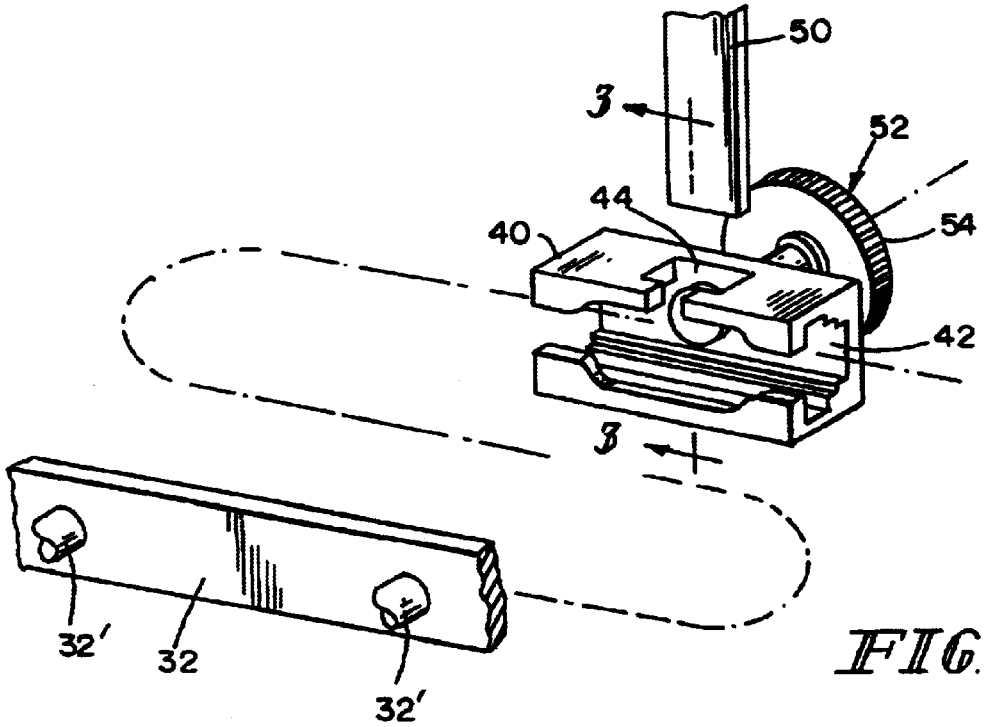
FIG. 2 is a perspective view showing the mounting rail, mount, horizontal and vertical channels for receiving the mounting rail and the mounting post, knob and the mounting post.
Figure 3:
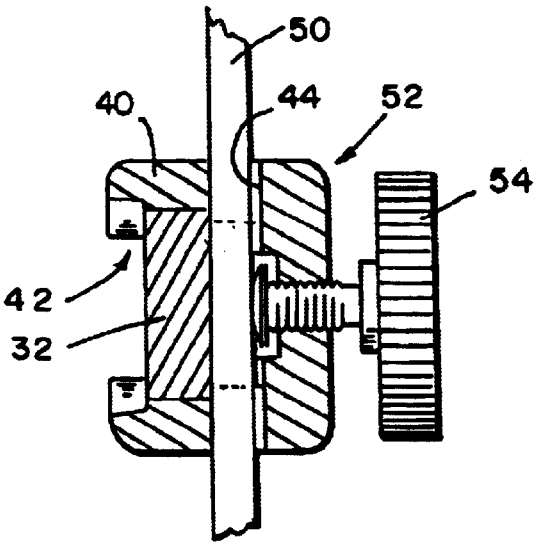
FIG. 3 is a sectional view of the mounting assembly of FIG. 2 along line 3—3 in FIG. 2.

Referring to FIGS. 2–3, the armboard assembly 20 includes a mount 40 having a horizontal channel 42 for receiving the mounting rail 32 and a vertical channel 44 for receiving the mounting post 50. The mounting post 50 can be vertically adjusted and fixed at a desired height relative to the patient support surface 28 by tightening a clamp 52 in the form of a threaded fastener provided with a grippable knob 54. In addition, the clamp 52 may be used to adjust a longitudinal position of the mount 40 along the rail 32. Although a specific clamp is disclosed herein for attaching the armboard assembly 20 to the mounting rail 32, it will be understood that other conventional rail clamps may very well be used in conjunction with the armboard assembly 20. The mount 40 and the clamp 52 are sometimes referred to herein as the lockable third joint.

Figure 4:
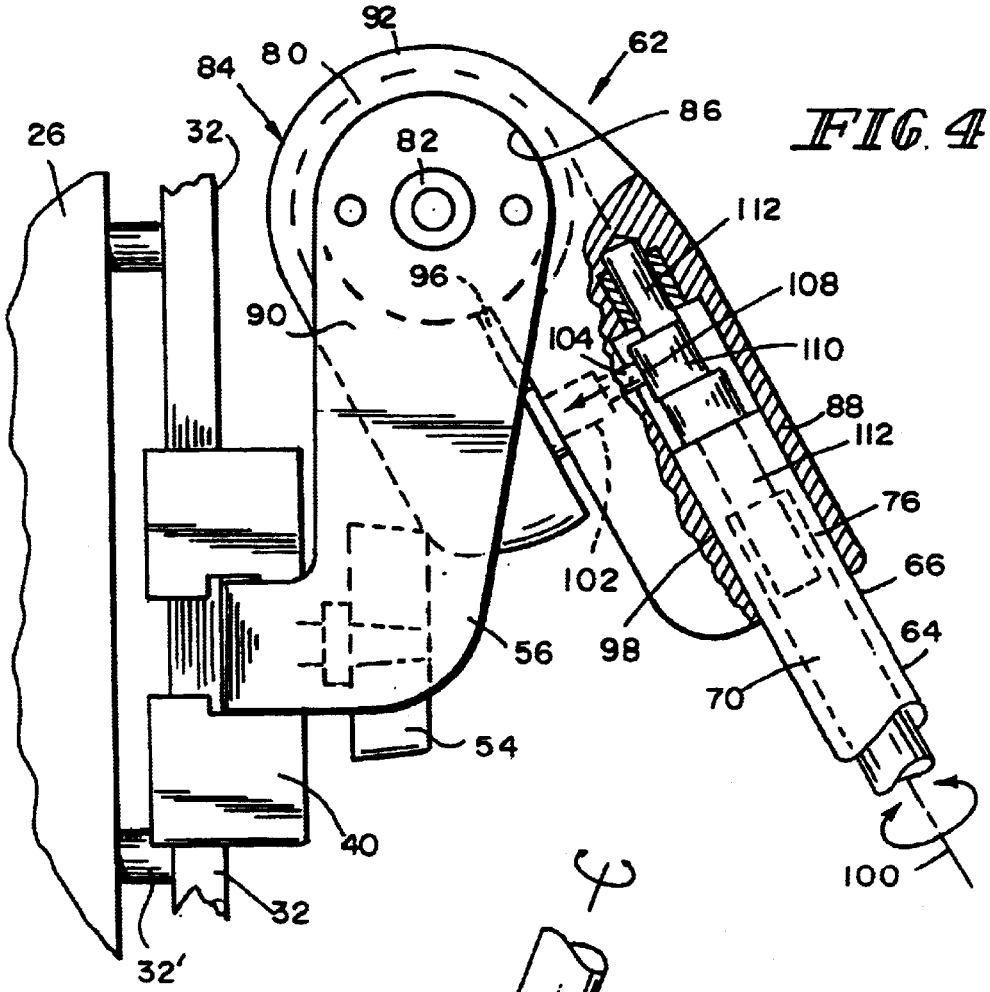
FIG. 4 is a top plan view showing the mounting rail, mount, mounting post, the swivel joint and the support arm.

The mounting post 50 includes a horizontally-extending bracket 56 extending parallel to the patient support surface 28. A lockable swivel joint 62 (sometimes referred to as the lockable second swivel joint) couples the support arm 64 to the horizontally-extending bracket 56 of the mounting post 50 as shown in FIG. 4. The support arm 64 includes a first end 66 coupled to the swivel joint 62 and a second end 68 spaced from the first end 66. An actuator shaft 70 extends through an interior region of the support arm 64. The actuator shaft 70 includes a first end 76 coupled to the swivel joint 62 and a second end 78 coupled to a handle 72 adjacent the second end 68 of the support arm 64. The handle 72 is movable between a first position in which the swivel joint 62 is locked and a second position in which the swivel joint 62 is unlocked. When unlocked, the swivel joint 62 is configured to permit simultaneous rotation of the support arm 64 relative to the post 50 about a plurality of axes.

As shown in FIGS. 4–8, the swivel joint 62 includes a spherical disc 80 coupled to the horizontally-extending bracket 56 of the mounting post 50 by a vertically-extending pin 82, and a split housing 84 coupled to the support arm 64 and formed to include a spherical seat 86 for receiving the spherical disc 80. The diameter of the disc 80 is slightly larger than the diameter of the spherical seat 86 to provide a relatively tight fit between the split housing 84 and the spherical disc 80 to normally lock the swivel joint 62 against movement. The split housing 84 includes a relatively long arm portion 88, a relatively short arm portion 90 and a base portion 92 connecting the two split arm portions 88, 90. The base portion 92 is formed to include the spherical cavity 86 having a vertical axis 94. The spherical cavity 86 includes a vertically extending gap 96 in communication with the space between the two split arm portions 88, 90. The relatively long arm portion 88 includes a horizontally extending opening 98 having a horizontal axis 100. The first end 66 of the support arm 64 is inserted into the opening 98 and secured thereto by a set screw (not shown). The actuator shaft 70 extending through the support arm 64 is rotatable about the horizontal axis 100. The relatively long arm portion 88 is further formed to include a horizontal channel 102 that is at right angle to and in communication with the horizontally extending opening 98. A lock release pin 104 is slidably received in the channel 102. One end 106 of the release pin 104 is configured to engage the short arm 90 and the other end 108 is configured to engage an off-center cam portion 110 of a cam shaft 112 secured to the actuator shaft 70 adjacent to the first end 76. Rotation of the handle 72 causes the cam portion 110 to push the release pin 104 outward against the short arm 90 to, in turn, cause the two arm portions 88, 90 to loosen their grip on the spherical disc 80 to unlock the swivel joint 62. The handle 72 can then be used to manipulate the armboard assembly 20 to a desired position.

An upwardly and inwardly extending support 120 has a first end 122 coupled to the armboard 22 and a second end 124 coupled to the support arm 64 by means of a support assembly 130 (sometimes referred to herein as the lockable first swivel joint). As explained below, the support assembly 130 is movable axially along the support arm 64, and is lockable in a plurality of positions along the support arm 64. The support assembly 130 includes a ball joint 132 and a housing 134 containing an inner frame 136 as shown in FIG. 9. The frame 136 is positioned about the inner periphery 138 of the housing 134, and includes a central aperture 140 and a central bore 142. The aperture 140 is sized to hold a ball 150 in place at contacts 152. The ball 150 is free to simultaneously rotate about a plurality of axes within the confines of the aperture 140.

The bore 142 is configured to receive an insert 156 and the support arm 64. A threaded end 158 of a hand lever 160 extends through the housing 134 and the inner frame 136 to engage the insert 156. As the threaded end 158 extends into the housing 134, a force is applied to the insert 156. This force in turn applies a force against both the ball 150 and the support arm 64 locking the ball 150 and the support arm 64 against movement. This locks the longitudinal position of the support assembly 130 along the support arm 64, and also locks the angular position of the ball 150 and the armboard 22 secured thereto. The support 120 extends from ball 150 through an aperture 162 in the housing 134.

Figure 12:
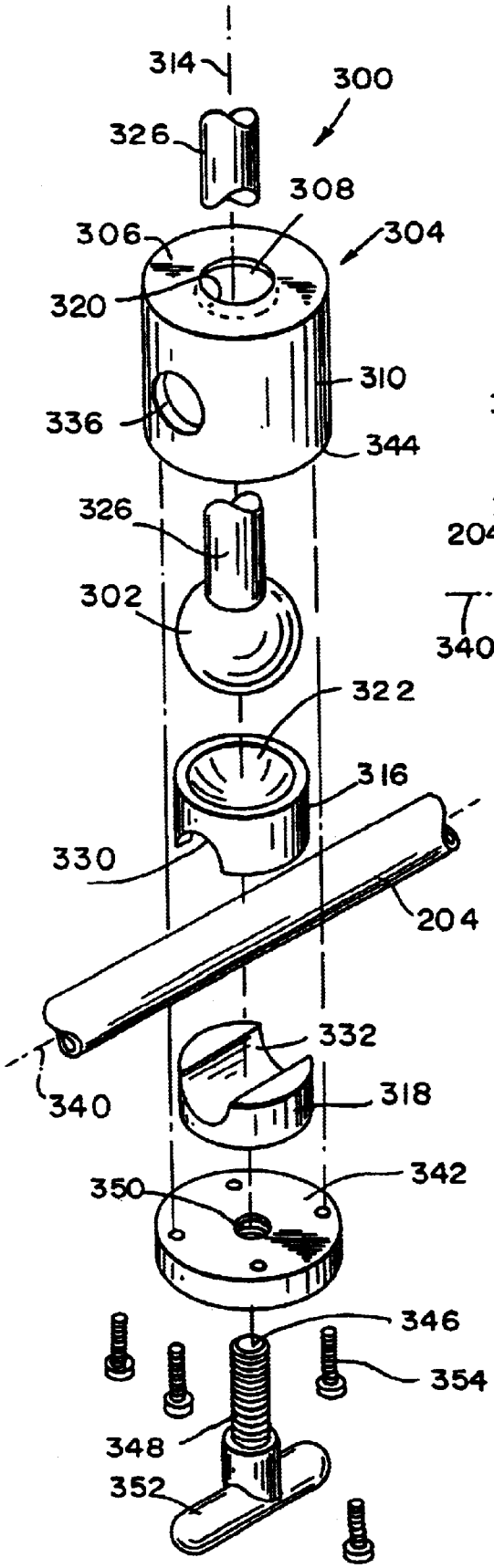
FIG. 12 is an exploded perspective view of the first swivel joint including a ball configured to be coupled to the armboard, a housing movable axially along the support arm, a top wall of the housing configured to form a semi-spherical seat on the bottom side thereof, a top insert configured to form a semi-spherical seat on the top side thereof and a semi-circular channel on the bottom side thereof, a bottom insert configured to form a semi-circular channel on the top side thereof, a cover plate configured to be secured to the bottom wall of the housing, a locking screw threaded into the cover plate to engage the bottom insert, and a handle coupled to the locking screw.
Figure 13:
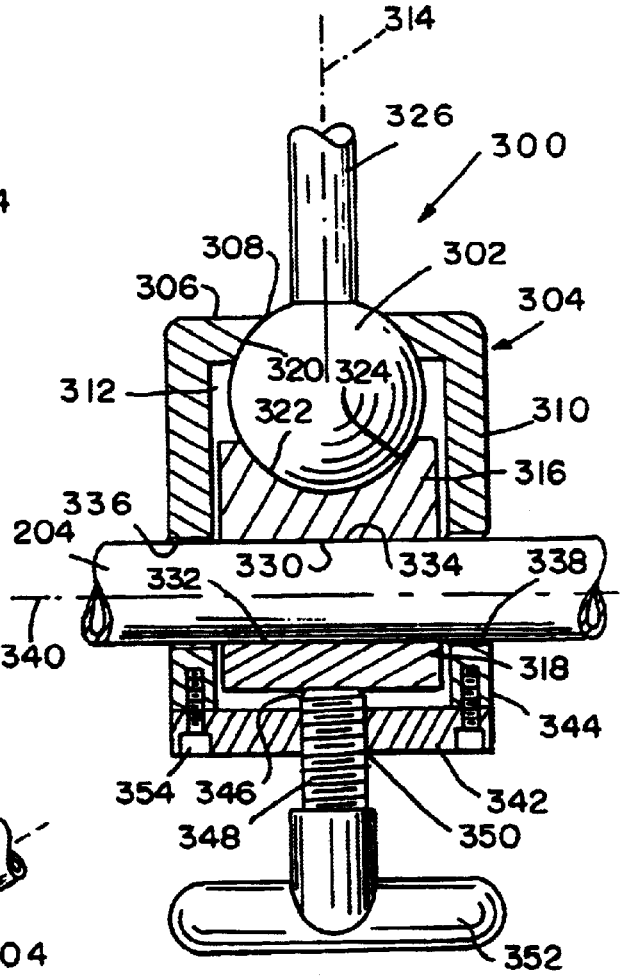
FIG. 13 is a sectional view of the first swivel joint along its center line.
Figure 18:
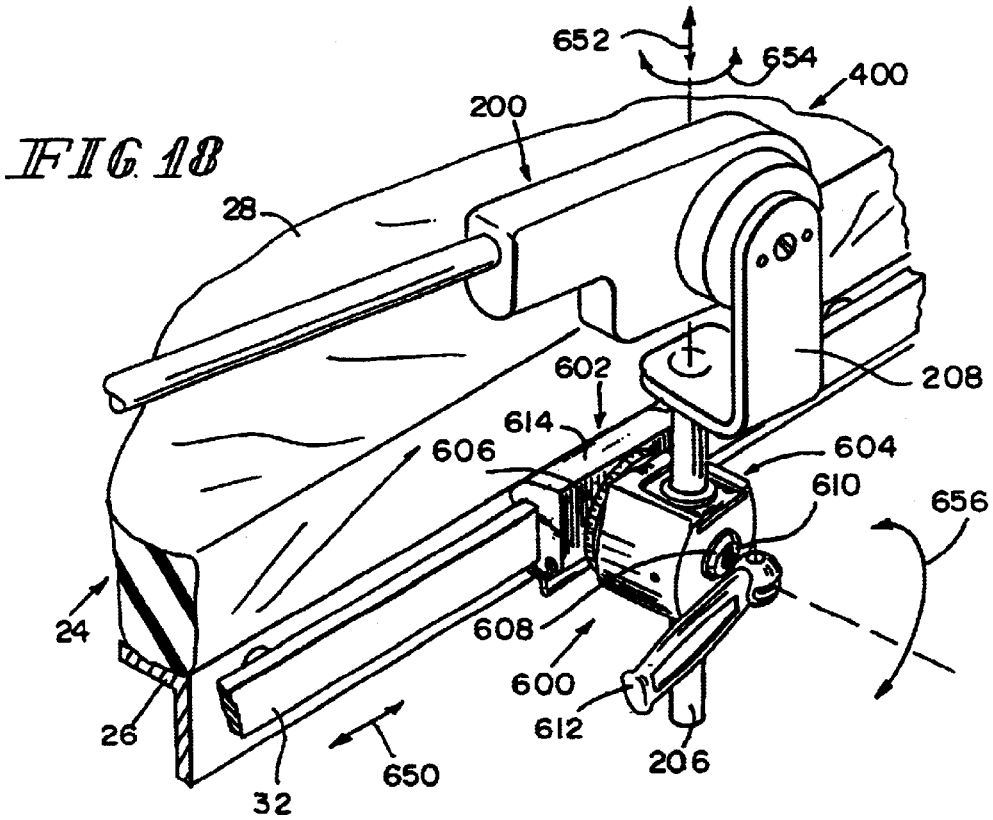
FIG. 18 is a perspective view of the lockable third joint coupling the mounting post to the mounting rail of the surgical table.
Figure 19:
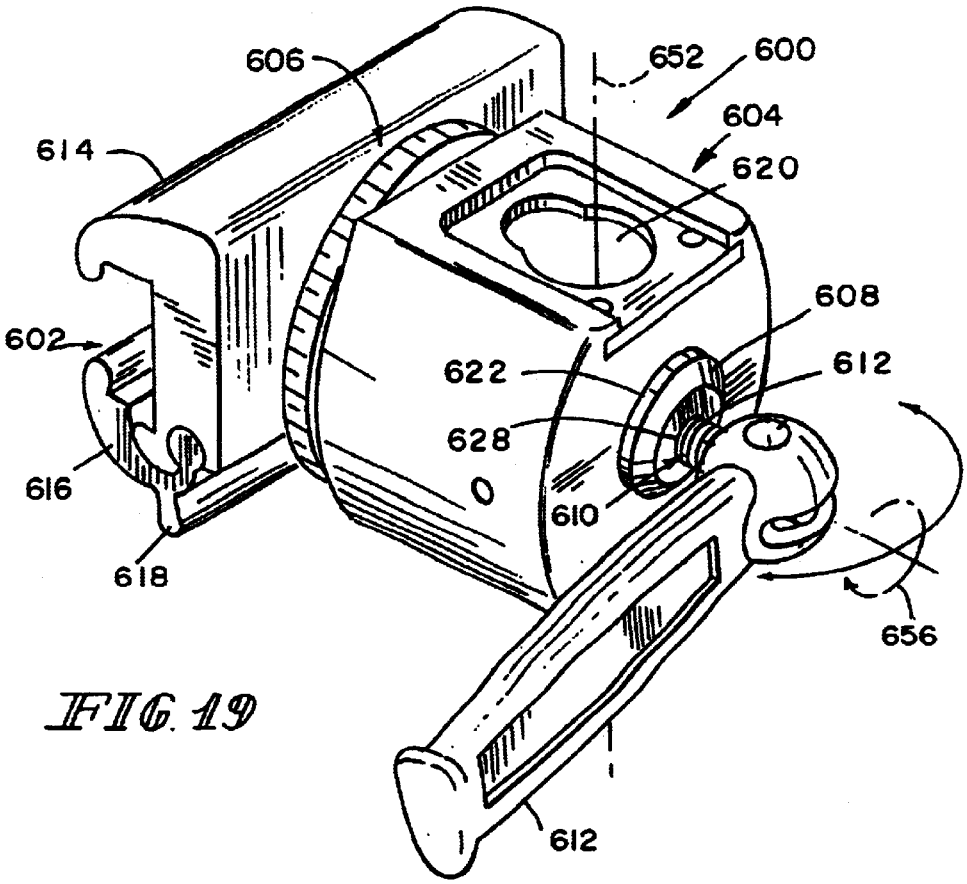
FIG. 19 is a perspective view of the lockable third joint.
Figure 20:
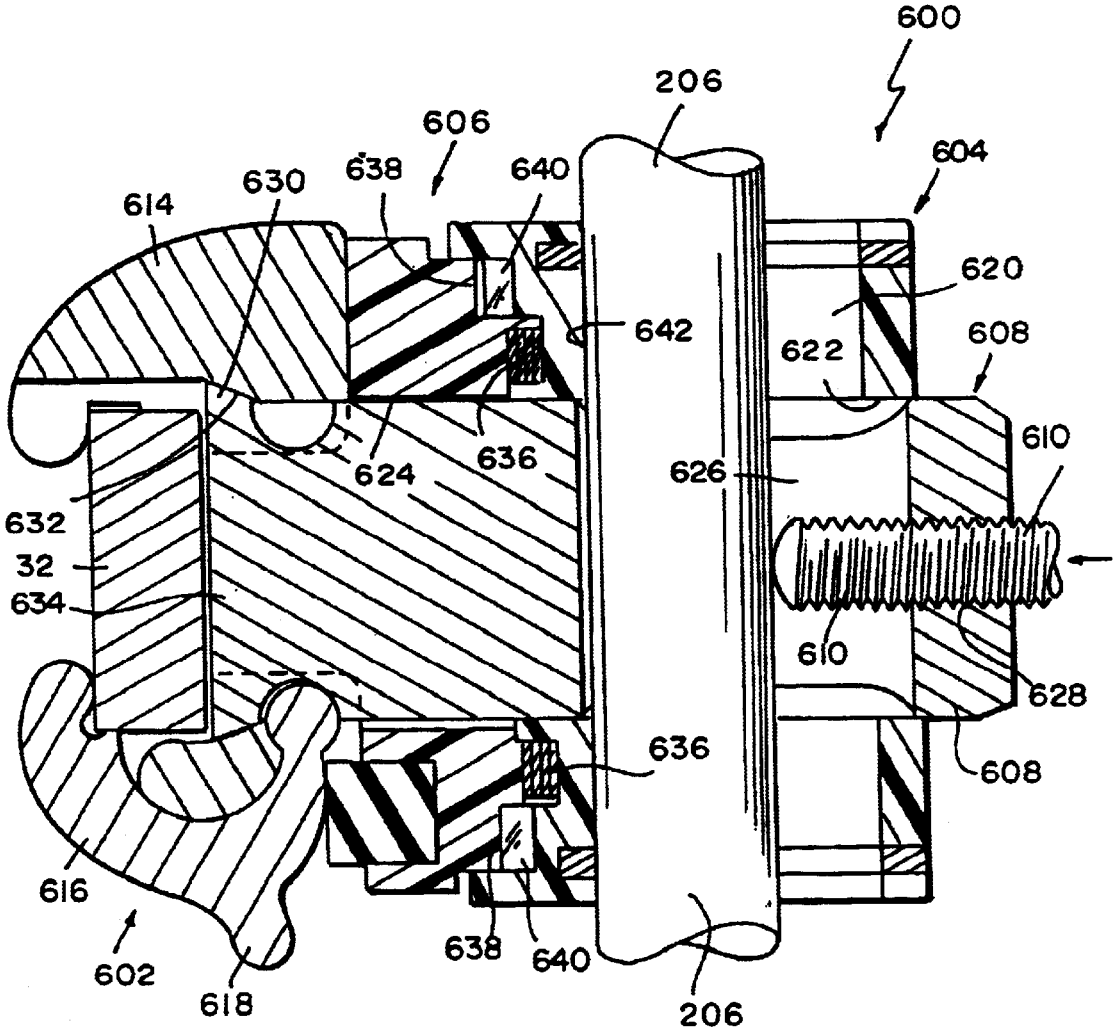
FIG. 20 is a sectional view of the lockable third joint showing the mounting post clamped to the mounting rail.

A second embodiment of the armboard assembly 200 is shown in FIGS. 10–20. Referring to FIGS. 10 and 11, the armboard assembly 200, like the armboard assembly 20 shown in FIGS. 1–9, includes three lockable joints: 1) a lockable first swivel joint 300 coupled to an armboard 202 and coupled to a tubular support arm 204 as shown in FIGS. 12 and 13, 2) a lockable second swivel joint 400 coupled to the support arm 204 and coupled to a mounting post 206 as shown in FIGS. 14–17, and 3) a lockable third joint 600 coupled to the mounting post 206 coupled to the mounting rail 32 of the surgical table 24 as shown in FIGS. 18–20. An inwardly-offset mounting bracket 208 is welded to the post 206 for supporting the armboard assembly 200. Illustratively, the support arm 204, the mounting post 206 and the bracket 208 are all stainless steel.

Figure 21:
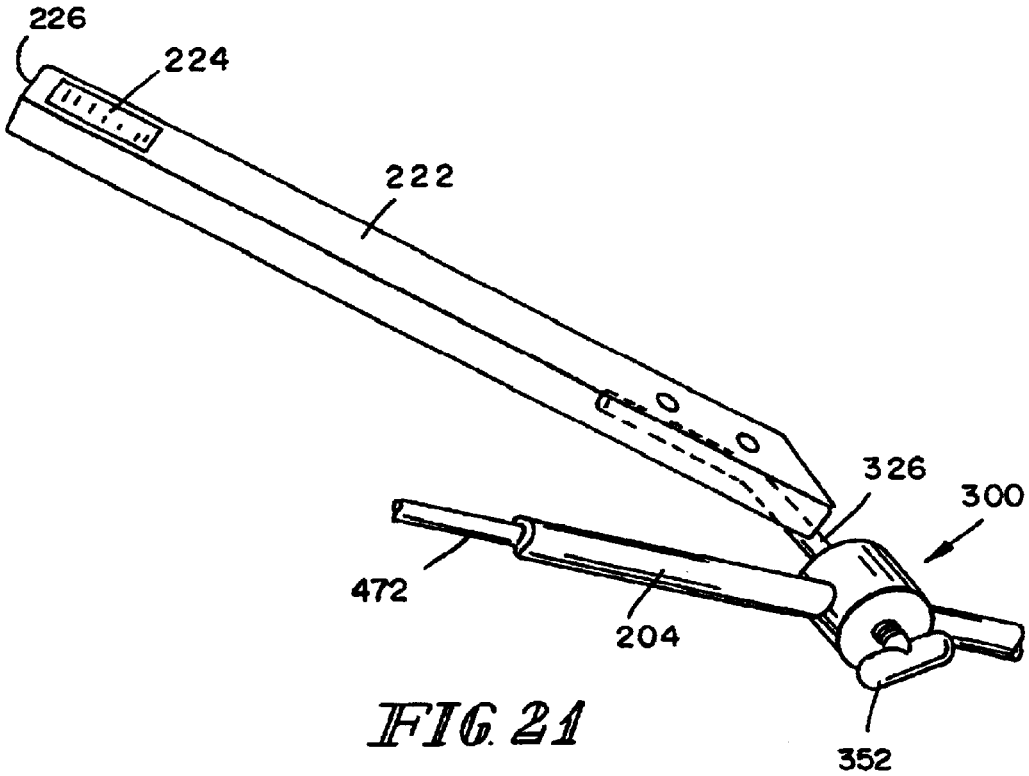
FIG. 21 is a perspective view of an alternative embodiment of the armboard which is generally flat and has a rectangular configuration.

The illustrated armboard 202 is curved to follow the contour of the patient's arm. As shown in FIGS. 10 and 11, the armboard 202 includes an upwardly concave proximal section for supporting the patient's forearm. From the upwardly concave proximal section, the armboard 202 dips downward in a wrist region and terminates in an almost dome-shaped distal section for supporting the patient's palm. The armboard 202 is made from radiolucent material to facilitate fluoroscopic imaging. The armboard 202 may be enclosed in a disposable pad (not shown). An alternative embodiment 222 of the armboard is shown in FIG. 21. The armboard 22 is generally flat and has a rectangular configuration. The armboard 222 includes a cutout 224 to form a hand grip 226 to facilitate positioning of the armboard 222.

As shown in FIGS. 12 and 13, the first swivel joint 300 includes a ball 302 coupled to the armboard 202 and a housing 304 movable along the support arm 204. The housing 304 includes a circular top wall 306 having a central aperture 308 and an annular body 310 having a central bore 312. The central aperture 308 and the central bore 312 define a vertically-extending axis 314. The bore 312 is configured to receive two circular inserts 316, 318, referred to herein as top and bottom inserts 316, 318. A downwardly-facing surface of the top wall 306 is configured to form a semi-spherical seat 320. Likewise, an upwardly-facing surface of the top insert 316 is configured to form a semi-spherical seat 322. The semi-spherical seats 320, 322 form a spherical seat 324 for the ball 302. The spherical seat 324 is configured to allow simultaneously rotation of the ball 302 about a first plurality of axes. A support 326 extends from the ball 302 through the central aperture 308 in the top wall 306 and couples to the armboard 202.

A downwardly-facing surface of the top insert 316 is configured to form a semi-circular channel 330. Likewise, an upwardly-facing surface of the bottom insert 318 is configured to form a semi-circular channel 332. The semi-circular channels 330, 332 form a circular channel 334 for the support arm 204. Two oversized openings 336, 338 are formed in the oppositely-disposed walls of the housing 304 in axial alignment with the circular channel 334. The support arm 204 passes through the oversized opening 336 on one side of the housing 304, through the circular channel 334 formed by the inserts 316, 318, and then through the oversized opening 338 on the other side of the housing 304. The circular channel 334 and the openings 336, 338 define a longitudinally-extending axis 340 that is disposed at right angle to the vertical axis 314 formed by the central aperture 308 and the central bore 312.

A cover plate 342 is secured to the bottom wall 344 of the housing 304 by a plurality of screws 354. A threaded end 346 of a turn screw 348 extends through a threaded opening 350 in the cover plate 342 to engage the bottom insert 318. The turn screw carries a knob 352. Rotation of the knob 352 in a locking direction extends the threaded end 346 into the housing 304. Rotation of the knob 352 in an opposite unlocking direction retracts the threaded end 346 from the housing 304. As the threaded end 346 extends into the housing 304, a downwardly-directed force is applied to the housing 304 and an upwardly-directed force is applied to the bottom insert 318 in a scissor-like action. As a result, the ball 302 is clamped between the top wall 306 and the top insert 316, and the support arm 204 is clamped between the two inserts 316, 318. This locks the longitudinal position of the housing 304 along the support arm 204, and also locks the angular position of the ball 302 and the armboard 202 secured thereto.

Illustratively, the following materials are used for the first swivel joint 300. The ball 302, housing 304, the cover plate 342 and the knob 352 are aluminum. The inserts 316, 318 and the turn screw 348 are tool steel. The armboard support 326 is stainless steel.

The second swivel joint 400 shown in FIGS. 14–17 for coupling the support arm 204 to the mounting post 206 is similar to the second swivel joint 62 shown in FIGS. 4–8. The second swivel joint 400 includes a pair of spherical split rings 402 mounted on a shaft 404 coupled to the mounting bracket 208 (corresponding to the spherical disc 80 coupled to the mounting bracket 56 in FIGS. 4–8), and a split housing 406 coupled to the support arm 204 and configured to form a spherical seat 408 for receiving the split rings 402 (corresponding to the split housing 84 coupled to the support arm 64 in FIGS. 4–8). The shaft 404 has a stepped structure formed by a mounting portion 410 on which the split rings 402 are mounted, an intermediate portion 412 and a mounting flange 414 configured to be coupled to the mounting bracket 208. The mounting portion 410 of the shaft 404 includes a collar 416. A washer 418 is secured to the mounting portion 410 by a screw 420. The split rings 402 are clamped to the mounting portion 410 between the collar 416 and the washer 418.

The mounting portion 410 of the shaft 404 has two oppositely-disposed axially-extending circumferential grooves 422 for receiving a pair of Woodruff keys 424. The Woodruff keys 424 extend between the split rings 402 to prevent their rotation about to the mounting shaft 404 when the support arm 204 is rotated. The mounting flange 414 is secured to the mounting bracket 208 by a set screw 426. A pair of locking pins 428 extending through the mounting bracket 208 and the mounting flange 414 prevent rotation of the mounting shaft 404 relative to the mounting bracket 208 when the support arm 204 is rotated. The split rings 402, the mounting shaft 404 and the split housing 406 are all disposed about a transversely-extending axis 430.

The split housing 406, like the split housing 84 in FIGS. 4–8, includes a top half 432, a bottom half 434 and a base portion 436 connecting the two halves 432, 434. The base portion 436 is configured to form the spherical seat 408 for the split rings 402 mounted on the shaft 404. The base portion 436 includes a radially-extending gap 438 in communication with the space between the two halves 432, 434. The radially-extending gap 438 allows contraction of the spherical seat 408 to prevent rotation of the support arm 206 about the mounting shaft 404 when the two halves 432, 434 are drawn together. The gap 438 also allows expansion of the spherical seat 408 to allow rotation of the support arm 206 about the mounting shaft 404 when the two halves 432, 434 are spread apart.

The outer peripheral surface of each split ring 402 is configured to form a coaxial circumferential groove 440 that is rectangular in configuration. The spherical seat 408 includes a circular receptacle 442 for receiving a radially inwardly-extending brass shoe 444. The brass shoe 444 has a cylindrical base that is rotatably received in the receptacle 442 and a square head that extends into the peripheral groove 440 in one of the two split rings 402. This shoe-in-the groove feature limits rotation of the support arm 204 about the mounting shaft 404 while allowing side-to-side movement of the support arm 204 about an axis 446 that is perpendicular to the transversely-extending axis 430 of the mounting shaft 404. The support arm 204 is rotatable about the mounting shaft 404 between a position that is about thirty degrees below a horizontal axis to a position about one hundred and fifty degrees above the horizontal axis, a total of about one hundred and eighty degrees.

The top half 432 includes an elongated opening 450 in alignment with the support arm 204. A first end 216 of the support arm 204 is inserted into the opening 450, and secured therein by a set screw 452. The top and bottom halves 432, 434 include a plurality of bores forming a stepped structure that is arranged in a stacked configuration about a vertically-extending axis 454 that is perpendicular to the longitudinally-extending axis 340 of the support arm 204. The top half 432 includes a threaded bore 456 that extends perpendicularly to and in communication with the elongated opening 450. The bottom half 434 includes an oversized bore 458 adjacent to and coaxial with the threaded bore 456, and a relatively large diameter bore 460 adjacent to and coaxial with the oversized bore 458. The bore 456 in the top half 432 and the bores 458, 460 in the bottom half 434 are disposed about the vertically-extending axis 454. The bores 458, 460 in the bottom half 434 form an annular seat 462 for a Belleville washer 464. A tension setting screw 466 extends through the Belleville washer 464 and the oversized bore 456, and is screwed into the threaded bore 454 in the top half 432. When the tension setting screw 466 is threaded into the top half 432, the two halves 432, 434 of the split housing 406 are drawn together to cause the split housing 406 to constrict around the spherical rings 402. When the tension setting screw 466 is rotated in the opposite direction, the Belleville washer 464 causes the two halves 432, 434 to spread apart to cause the split housing 406 to loosen its grip on the spherical rings 402. Initially, the tension setting screw 466 sets the tension between the split rings 402 and the split housing 406 at a point where rotation of the support arm 204 about the mounting shaft 404 is prevented, and the swivel joint 400 is locked against movement.

Figure 14:
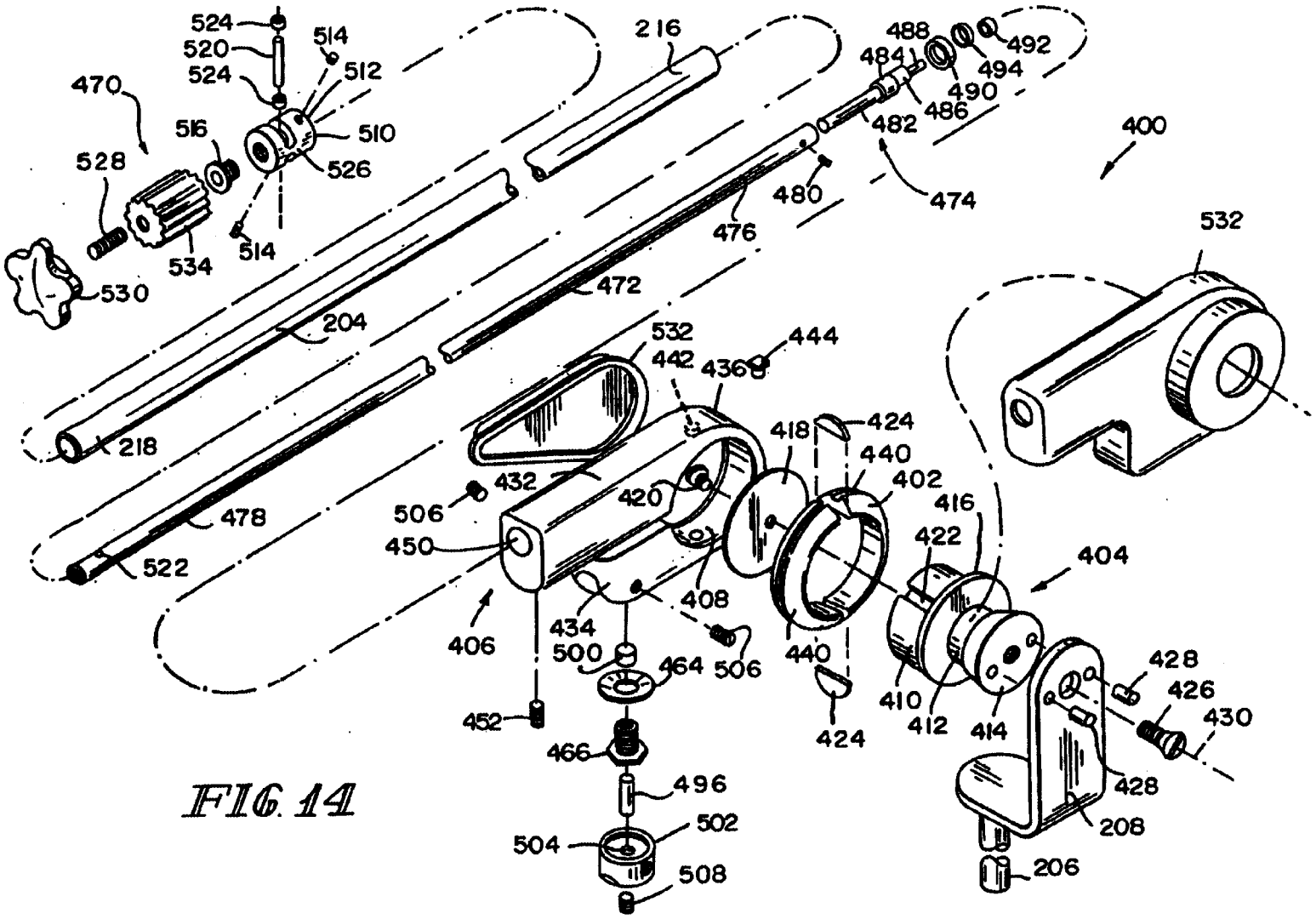
FIG. 14 is an exploded view of the second swivel joint including a split housing configured to be coupled to the support arm, the split housing including a top half and a bottom half configured to form a spherical seat for a pair of spherical split rings configured to be mounted on a mounting shaft coupled to the mounting post, and showing the support arm comprising an outer tube, a coaxial inner tube and a cam shaft coupled to the inner tube, a tension setting screw extending through a Belleville washer and through an oversized opening in the bottom half and threaded into the top half to cause the two halves to constrict around the spherical rings mounted on the shaft, a cam follower, a lock release pin extending through the tension setting screw, a cover plate configured to be coupled to the bottom half and a set screw threaded into the cover plate for positioning the cam follower against the cam shaft.
Figures 15, 16, 17:
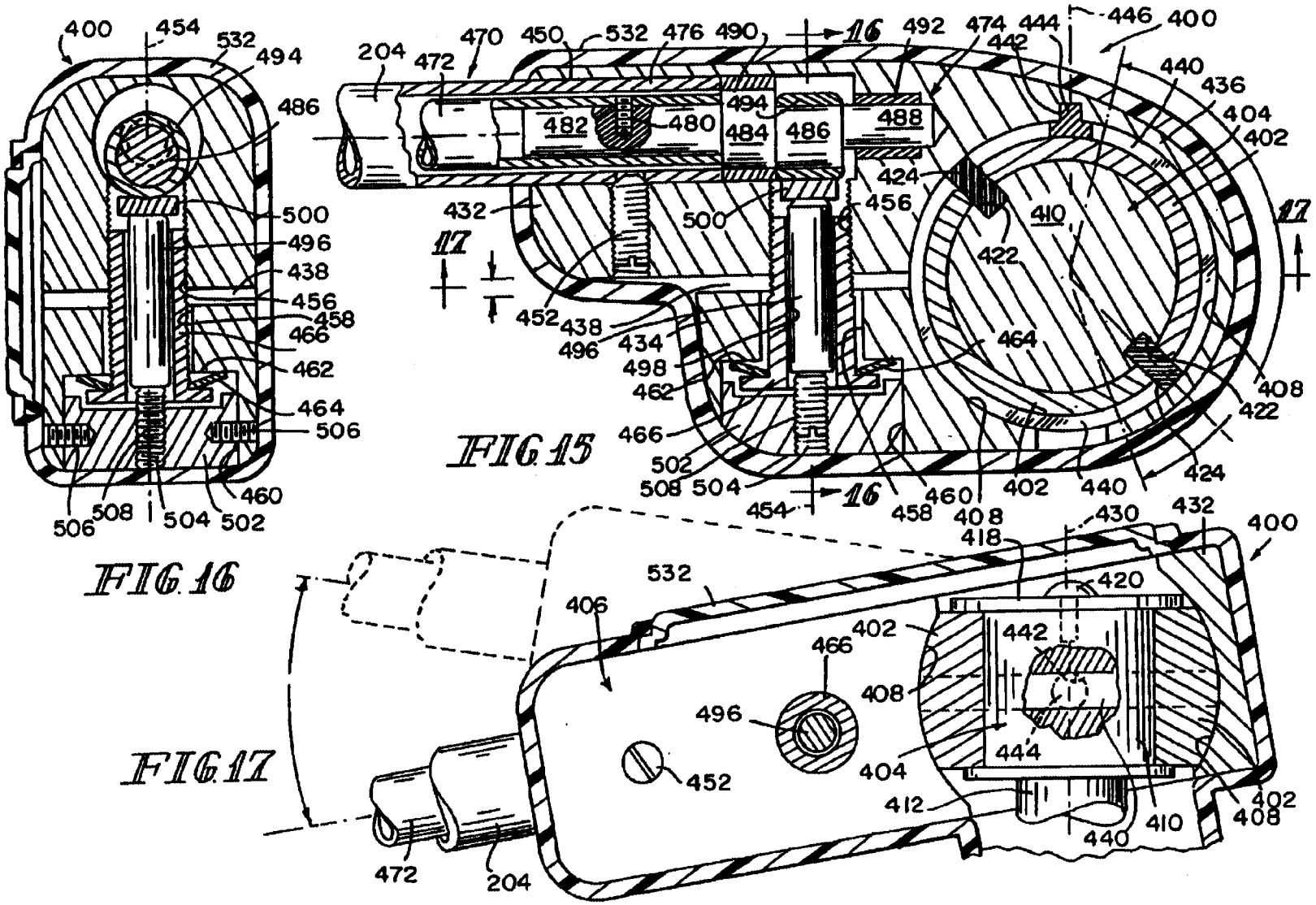
FIG. 15 is a sectional elevation view of the second swivel joint along its center line.
FIG. 16 is a sectional end view of the second swivel joint along line 16—16 in FIG. 15.
FIG. 17 is a sectional bottom view of the second swivel joint along line 17—17 in FIG. 15.

An actuator assembly 470 is coupled to the support arm 204 to selectively unlock the swivel joint 400 so that the support arm 204 can be manipulated to position the armboard 202. As shown in FIGS. 14 and 15, the actuator assembly 470 includes an actuator shaft 472 in the form of an inner tube extending through the support arm 204 in the form of an outer tube. The actuator shaft 472 is coupled to a cam shaft 474. The cam shaft 474 is inserted into the hollow end of the actuator shaft 472 adjacent to a first end 476, and secured therein by a set screw 480. The cam shaft 474 has a stepped structure formed by a first small diameter portion 482 coupled to the actuator shaft 472, a second large diameter portion 484, a third off-center cam portion 486 and a fourth small diameter portion 488. The cam shaft 474 is rotatably supported in the elongated opening 450 for rotation about the longitudinally-extending axis 340 of the support arm 204 by two bushings 490, 492 in engagement with the shaft portions 484, 488. A third bushing 494 is disposed about the off-center cam portion 486.

A lock release pin 496 extends through an axial opening 498 in the tension setting screw 466 to engage a cam follower 500 which, in turn, engages the bushing 494 mounted on the cam portion 486. A cover plate 502 having a threaded aperture 504 is inserted in the relatively large diameter bore 460, and secured therein by two locking pins 506. A set screw 508 is threaded into the threaded aperture 504 to cause the lock release pin 496 to position the cam follower 500 to engage the bushing 494. A vinyl cover 532 encloses the split housing 406. Rotation of the actuator shaft 472 causes rotation of the cam shaft 474. Rotation of the cam shaft 474 pushes the lock release pin 496 away from the top half 432. The lock release pin 496, in turn, pushes the bottom half 434 away from the top half 432 to cause the split housing 406 to loosen its grip on the split rings 402 allowing manipulation of the support arm 204 to position the armboard 202.

The actuator assembly 470 includes a handle mount 510 having a central bore 512. The second end 218 of the support arm 204 is inserted into the bore 512, and secured therein by two screws 514. The second end 478 of the actuator shaft 472 extends beyond the second end 218 of the support arm 204. A bushing 516 coupled to the distal end of the handle mount 510 rotatably supports the free end of the actuator shaft 472. The handle mount 510 includes two transversely-extending circumferential slots 518. A limit pin 520 is inserted through one slot 518 on one side, through a transversely-extending opening 522 in the actuator shaft 472 and through the other slot 518 on the other side, and held in place by two nylon bushings 524. The slots 518 in the handle mount 510 form two shoulders 526 which cooperate with the transversely-extending limit pin 520 to limit the rotation of the actuator shaft 472 relative to the support arm 204. A turn screw 528 has a first end threaded into the hand wheel 530 and a second end threaded into the actuator shaft 472. A vinyl cap 534 encloses the mount 510. Rotation of the hand wheel 530 causes rotation of the actuator shaft 472, which, in turn, causes rotation of the cam shaft 474 coupled to the lock release pin 496. Normally, the hand wheel 530 is disposed in a position corresponding to a dead-center position of the cam shaft 474. In this position, the two halves 432, 434 of the split housing 406 constrict around the split rings 402 to lock the swivel joint 400 against movement. The hand wheel 430 can be turned in either direction to spread apart the two halves 432, 434 to loosen their grip on the split rings 402 to unlock the swivel joint 400, so that the support arm 204 can be manipulated to position the armboard 202.

Illustratively, the following materials are used for the second swivel joint 400. The split rings 402 are cast iron. The shaft 404, the housing 406 and the handle mount 510 are aluminum. The actuator shaft 472 is stainless steel. The cam shaft 474 is tool steel. The bushing 516 is plastic. The covers 532, 534 are vinyl.

The lockable third joint 600 (also referred to herein as mounting assembly) clamps the mounting post 206 to the mounting rail 32. The mounting assembly 600 provides the mounting post 206 a multiple degrees of freedom. The mounting assembly 600 is movable along the mounting rail 32 in either direction as indicated by a double-headed arrow 650. The mounting post 206, which is about twelve inches (about 30 centimeters) long, is vertically adjustable in either direction as indicated by a double-headed arrow 652. Also, the mounting post 206 is rotatable about its axis in either direction as indicated by a double-headed arrow 654. In addition, the mounting assembly 600 is rotatable about a transverse axis either direction as indicated by a double-headed arrow 656. The joint 600 may be of the type disclosed in U.S. Provisional Patent Application, Ser. No. 60/192,555, filed on Mar. 28, 2000, and entitled "SOCKET AND RAIL CLAMP APPARATUS", which is incorporated herein in its entirety by reference, now U.S. patent application, Ser. No. 09/814,148, filed on Mar. 21, 2001.

Referring to FIGS. 18–20, the mounting assembly 600 includes a clamp 602, a body 604, a lock 606, a coupling member 608, a locking screw 610 and a handle 612 coupled to the locking screw 610. The clamp 602 includes an upper jaw 614 and a lower jaw 616 movable relative to the upper jaw 614. The jaws 614, 616 are sized to receive the mounting rail 32. The lower jaw 616 includes a trigger portion 618, which when engaged by the user pivots the lower jaw 616 relative to the upper jaw 614. A vertically-extending bore 620 extends through the body 604 to receive the mounting post 206. A transversely-extending bore 622 extends through the body 604 at right angles to the vertically-extending bore 620 to receive the coupling member 608 in the form of a cylindrical pin. The lock 606 is sandwiched between the clamp 602 and the body 604. A transversely-extending bore 624 extends through the lock 606 coaxially with the bore 622 in the body 604 to receive the coupling member 608. A vertically-extending bore 626 extends through the coupling member 608 in coaxial alignment with the bore 620 to receive the mounting post 206. The locking screw 610 threadably engages a transversely-extending threaded bore 628 extending through the coupling member 608.

A beveled flange 630 is disposed about the periphery of the coupling member 608 on the side thereof adjacent to the mounting rail 32. The flange 630 is received in a countersunk bore 632 in the clamp 602. The coupling member 608 extends transversely from the clamp 602 through the lock 602 and the body 604. Resilient pads 634 bias the lock 606 away from the clamp 602, and a spring 636 biases the body 604 away from the lock 606. In this position, the body 604 can rotate about the transversely-extending coupling member 608 in either direction.

The lock 606 includes a plurality of circumferentially disposed teeth 638 which are configured to engage a plurality of circumferentially disposed teeth 640 in the body 604. When the handle 12 is turned in a locking direction, the locking screw 610 is extended into the vertically-extending bore 626 to engage the mounting post 206. As the locking screw 610 extends into the bore 626, the post 206 is forced against a peripheral wall 642 of the vertical bore 620 in the body 604. In addition, the clamp 602, the lock 606 and the body 604 are all drawn together so that the circumferentially-extending teeth 638 in the lock 606 are forced against the circumferentially-extending teeth 640 in the body 604 to prevent rotation of the body 604 about the coupling member 608. When the handle 12 is turned in an unlocking direction, the locking screw 610 disengages from the post 206 allowing the same to move in the vertical direction 652 and about the vertical axis 654. Once the post 206 is in the desired position, the handle 12 is turned in the opposite locking direction to lock the post 206 in place.

Although the invention has been described in detail with reference to a certain preferred embodiment, variations and modifications exist within the scope and spirit of the invention as described and as defined in the following claims.

What is claimed is:

1. A mounting assembly configured to selectively attach an accessory to a patient support having a mounting rail extending along a longitudinal dimension thereof, the mounting assembly comprising:

a support arm, a lockable first joint coupled to the accessory and coupled to the support arm, the first joint being configured to permit movement of the accessory along the support arm and configured to permit movement of the accessory relative to the support arm about a first plurality of axes, a post separate from the support arm, a lockable second joint coupled to a first end of the support arm and coupled to the post, the second joint being configured to permit movement of the support arm relative to the post about a second plurality of axes, a handle coupled to a second end of the support arm, the handle being movable between a first position in which the lockable second joint is locked and a second position in which the lockable second joint is unlocked, and a lockable third joint coupled to the post and coupled to the rail, the third joint being configured to position the post in a selected vertical position relative to the rail and in a selected longitudinal position along the rail.

2. The mounting assembly of claim 1, wherein the lockable second joint includes a swivel joint.

3. The mounting assembly of claim 1, wherein the lockable first and second joints each include a swivel joint.

4. The mounting assembly of claim 1, wherein the lockable first joint includes a handle configured to lock the accessory at a selected longitudinal position along the support arm, and lock the accessory against movement relative to the support arm about the first plurality of axes.

5. The mounting assembly of claim 1, wherein the lockable first joint includes a ball joint to which the accessory is coupled for movement about the first plurality of axes, the ball joint including a housing movable along the support arm and a handle coupled to the housing and configured to lock the housing at a selected longitudinal position along the support arm and lock the ball joint against movement about the first plurality of axes.

6. The mounting assembly of claim 1, including a handle, wherein the lockable second joint is coupled to the first end of the support arm, the handle is coupled to the second end of the support arm, and wherein the handle is rotatable in a first direction to lock the support arm against movement relative to the post and is rotatable in a second direction to permit movement of the support arm relative to the post about the second plurality of axes.

7. The mounting assembly of claim 1, wherein the lockable second joint includes a swivel joint to which the support arm is coupled for movement about the second plurality of axes, the handle being configured to lock the swivel joint against movement about the second plurality of axes.

8. The mounting assembly of claim 1, wherein the lockable second joint comprises a swivel joint including:

a spherical disc coupled to the post, and a split housing coupled to the first end of the support arm, the split housing including first and second halves configured to form a spherical seat for receiving the spherical disc for rotation about the second plurality of axes, and wherein the handle is movable between a first position in which the two halves of the split housing constrict around the spherical disc to lock the swivel joint against movement and a second position in which two halves are spread apart to loosen their grip on the spherical disc to unlock the swivel joint.

9. The mounting assembly of claim 8, wherein the spherical disc comprises a pair of split rings mounted on a shaft coupled to the post.

10. The mounting assembly of claim 8, wherein the support arm is in the form of an outer tube, wherein the swivel joint includes an actuator shaft extending through the outer tube, wherein the actuator shaft has a first end coupled to a cam shaft and a second end coupled to the handle, and wherein the swivel joint includes a lock release pin in engagement with the cam shaft so that movement of the handle to the second position causes the cam shaft to push the lock release pin to, in turn, cause the two halves to spread apart to loosen their grip on the spherical disc to unlock the swivel joint.

11. The mounting assembly of claim 1, wherein the lockable third joint includes a handle configured to lock the post in a selected vertical position relative to the rail and in a selected longitudinal position along the rail.

12. The mounting assembly of claim 11, wherein the lockable third joint is configured to permit rotation of the post about a generally vertical axis and about a generally transverse axis, and wherein the handle of the lockable third joint is additionally configured to lock the post against movement about the vertical and transverse axes.

13. The mounting assembly of claim 1, wherein the accessory is an armboard configured to support a patient's arm.

14. The mounting assembly of claim 13, wherein the armboard is made from a radiolucent material.

15. The mounting assembly of claim 13, wherein the armboard is a flat surface to support the patient's arm.

16. The mounting assembly of claim 13, wherein the armboard is curved to follow the contour of the patient's arm.

17. A mounting assembly configured to selectively attach an accessory to a patient support having a mounting rail extending along a longitudinal dimension thereof, the mounting assembly comprising:

a support arm, a lockable first swivel joint coupled to the accessory and coupled to the support arm, the lockable first swivel joint being configured to permit movement of the accessory along the support arm and configured to permit movement of the accessory relative to the support arm about a first plurality of axes, a post separate from the support arm coupled to the rail, a lockable second swivel joint coupled to a first end of the support arm and coupled to the post, the lockable second swivel joint being configured to permit movement of the support arm relative to the post about a second plurality of axes, and a handle coupled to a second end of the support arm, the handle being movable between a first position in which the lockable second swivel joint is locked and a second position in which the lockable second swivel joint is unlocked.

18. The mounting assembly of claim 17, including a lockable third joint coupled to the rail and coupled to the post, the third joint being configured to position the post in a selected vertical position relative to the rail and in a selected longitudinal position along the rail.

19. The mounting assembly of claim 17, wherein the accessory is an armboard configured to support a patient's arm.

20. The mounting assembly of claim 19, wherein the armboard is made from a radiolucent material.

21. The mounting assembly of claim 19, wherein the armboard is a flat surface to support the patient's arm.

22. The mounting assembly of claim 19, wherein the armboard is curved to follow the contour of the patient's arm.

23. A mounting assembly configured to selectively attach an accessory to a patient support having a mounting rail extending along a longitudinal dimension thereof, the mounting assembly comprising:

a mount, a generally vertical post, a clamp configured to position the vertical post in a selected vertical position and position the mount in a selected longitudinal position along the rail, a swivel joint coupled to the vertical post, a support arm separate from the post and having a first end coupled to the swivel joint, a handle coupled to a second end of the support arm, the handle being movable between a first position in which the swivel joint is locked and a second position in which the swivel joint is unlocked, a body movable along the support arm, a ball joint coupled to the body, a lock coupled to the body to lock the body in a selected position along the support arm and lock the ball joint against movement, and a support coupled to the accessory and movable with the ball joint.

24. The mounting assembly of claim 23, wherein the accessory is an armboard configured to support a patient's arm.

25. The mounting assembly of claim 24, wherein the armboard is made from a radiolucent material.

26. The mounting assembly of claim 24, wherein the armboard is a flat surface to support the patient's arm.

27. The mounting assembly of claim 24, wherein the armboard is curved to follow the contour of the patient's arm.

28. A mounting assembly configured to selectively attach an accessory to a patient support having a mounting rail extending along a longitudinal dimension thereof, the mounting assembly comprising:

a support arm, a lockable first joint coupled to the accessory and coupled to the support arm, the first joint being configured to permit movement of the accessory along the support arm and configured to permit movement of the accessory relative to the support arm about a first plurality of axes, a post separate from the support arm, a lockable second joint coupled to a first end of the support arm and coupled to the post, the second joint being configured to permit movement of the support arm relative to the post about two mutually-perpendicular and intersecting axes, a handle coupled to a second end of the support arm, the handle being movable between a first position in which the lockable second joint is locked and a second position in which the lockable second joint is unlocked, and a lockable third joint coupled to the post and coupled to the rail, the third joint being configured to position the post in a selected vertical position relative to the rail and in a selected longitudinal position along the rail.

29. The mounting assembly of claim 28, wherein the post has a longitudinal axis, and wherein one of the two mutually-perpendicular and intersecting axes is also perpendicular to the longitudinal axis of the post.

30. The mounting assembly of claim 28, wherein the post has a longitudinal axis, and wherein longitudinal axis of the post passes through a point at which the two mutually-perpendicular axes intersect.

31. The mounting assembly of claim 28, wherein the post has a longitudinal axis, and wherein the lockable third joint is configured to permit pivoting movement of the post about the longitudinal axis.

32. The mounting assembly of claim 28, wherein the support arm has a longitudinal axis, and wherein one of the two mutually-perpendicular and intersecting axes is also perpendicular to the longitudinal axis of the support arm.

33. The mounting assembly of claim 28, wherein one of the two mutually-perpendicular and intersecting axes is a generally horizontal axis, and wherein the lockable second joint is configured to limit the range of movement of the support arm about the generally horizontal axis.

34. The mounting assembly of claim 28, wherein one of the two mutually-perpendicular and intersecting axes is a generally vertical axis, and wherein the lockable second joint is configured to limit the range of movement of the support arm about the generally vertical axis.

35. The mounting assembly of claim 28, wherein the accessory is an armboard configured to support a patient's arm.

36. The mounting assembly of claim 35, wherein the armboard is made from a radiolucent material.

37. The mounting assembly of claim 35, wherein the armboard is a flat surface to support the patient's arm.

38. The mounting assembly of claim 35, wherein the armboard is curved to follow the contour of the patient's arm.

* * * * *